US008044889B2

(12) United States Patent
Hwang et al.

(10) Patent No.: US 8,044,889 B2
(45) Date of Patent: Oct. 25, 2011

(54) PLASMA DISPLAY DEVICE

(75) Inventors: Eun Joo Hwang, Gumi-si (KR); Byung Ho Rhee, Gumi-si (KR); Byeong Uk Lee, Gumi-si (KR); Jae Won Shim, Gumi-si (KR); Mi Ok Kim, Gumi-si (KR); Yong Song, Gumi-si (KR); Takeshi Kuwahara, Gumi-si (KR)

(73) Assignee: LG Electronics Inc., Seoul (KR)

( * ) Notice: Subject to any disclaimer, the term of this patent is extended or adjusted under 35 U.S.C. 154(b) by 971 days.

(21) Appl. No.: 11/964,424

(22) Filed: Dec. 26, 2007

(65) Prior Publication Data

US 2008/0180428 A1 Jul. 31, 2008

(30) Foreign Application Priority Data

Dec. 26, 2006 (KR) ..... 10-2006-0133826

(51) Int. Cl.
*G09G 3/28* (2006.01)
*G09G 3/10* (2006.01)

(52) U.S. Cl. ..... 345/67; 345/60; 345/68; 345/211; 315/169.4

(58) Field of Classification Search ..... 345/60–72, 345/211; 315/169.4
See application file for complete search history.

(56) References Cited

U.S. PATENT DOCUMENTS

| | | | | |
|---|---|---|---|---|
| 6,680,581 | B2 * | 1/2004 | Lee et al. | 315/169.3 |
| 7,023,139 | B2 * | 4/2006 | Lee et al. | 315/169.1 |
| 7,542,015 | B2 * | 6/2009 | Son | 345/67 |
| 2003/0193454 | A1 * | 10/2003 | Lee et al. | 345/63 |
| 2006/0290610 | A1 * | 12/2006 | Moon et al. | 345/68 |

FOREIGN PATENT DOCUMENTS

KR 1020050059433 A1 * 7/2005

* cited by examiner

*Primary Examiner* — Lun-Yi Lao
*Assistant Examiner* — Sosina Abebe
(74) *Attorney, Agent, or Firm* — KED & Associates, LLP

(57) ABSTRACT

There is provided a plasma display device. The plasma display device includes a plasma display panel (PDP) and drivers for supplying driving signals to the PDP. The driver includes a capacitor, a first switch turned on in order to supply a voltage of a first end of both ends of the capacitor to the PDP, a second switch turned on in order to supply a voltage of a second end of both ends of the capacitor to the PDP, a first voltage supplier connected to the first end of the capacitor to supply one of a sustain voltage and a reference voltage to the first end, and a second voltage supplier connected to the second end of the capacitor to supply the reference voltage to the second end. A voltage difference between the both ends of the capacitor is sustained as the sustain voltage. In the plasma display device, since the conventional large capacity of pass switch and the negative polar scan voltage source—Yy are replaced by cheap capacitors with the driving signals for driving the PDP applied in the same way, it is possible to reduce the manufacturing cost of the plasma display device.

19 Claims, 14 Drawing Sheets

PLASMA DISPLAY DEVICE

This nonprovisional application claims priority under 35 U.S.C. §119(a) on Patent Application No. 10-2006-0133826 filed in Republic of Korea on Dec. 26, 2006, the entire contents of which are hereby incorporated by reference.

BACKGROUND OF THE INVENTION

1. Field of the Invention

The present invention relates to a plasma display device, and more particularly, to a device for driving a plasma display panel (PDP).

2. Description of the Conventional Art

In general, in a plasma display panel (PDP), barrier ribs formed between a top substrate and a bottom substrate form a unit cell. A main discharge gas such as neon (Ne), helium (He), and an air mixture of Ne+He and an inert gas including a small amount of xenon (Xe) are filled in each cell. When discharge is generated by a radiofrequency voltage, the inert gas generates vacuum ultraviolet (UV) rays. The UV rays emit light from phosphors formed between the barrier ribs to realize an image. Since the PDP can be made thin and light, the PDP is spotlighted as a next generation display device.

In order to drive the PDP, drivers for supplying driving signals to the electrodes formed on the PDP are required.

In order to control the driving signals, a panel driving circuit includes a plurality of switches. As large capacity of switches are used, manufacturing cost increases and heat is generated during switching so that energy is unnecessarily consumed.

SUMMARY OF THE INVENTION

A plasma display device according to the present invention includes a plasma display panel (PDP) and drivers for supplying driving signals to the PDP. The driver includes a capacitor, a first switch turned on in order to supply a voltage of a first end of both ends of the capacitor to the PDP, a second switch turned on in order to supply a voltage of a second end of both ends of the capacitor to the PDP, a first voltage supplier connected to the first end of the capacitor to supply one of a sustain voltage and a reference voltage to the first end, and a second voltage supplier connected to the second end of the capacitor to supply the reference voltage to the second end. A voltage difference between the both ends of the capacitor is sustained as the sustain voltage.

Another plasma display device according to the present invention includes a PDP and a scan driver for supplying driving signals to scan electrodes formed on a top substrate of the PDP. The scan driver includes a capacitor, a first switch turned on in order to supply a voltage of a first end of the capacitor to the scan electrodes, a second switch turned on in order to supply a voltage of a second end of the capacitor to the scan electrodes, and a first voltage supplier for supplying one of a first signal that gradually rises from the first end of the capacitor to a sustain voltage and a second signal that gradually falls to a reference voltage. A voltage difference between the first and the second end of the capacitor is sustained as the sustain voltage.

DETAILED DESCRIPTION OF PREFERRED EMBODIMENTS

Figure 1:
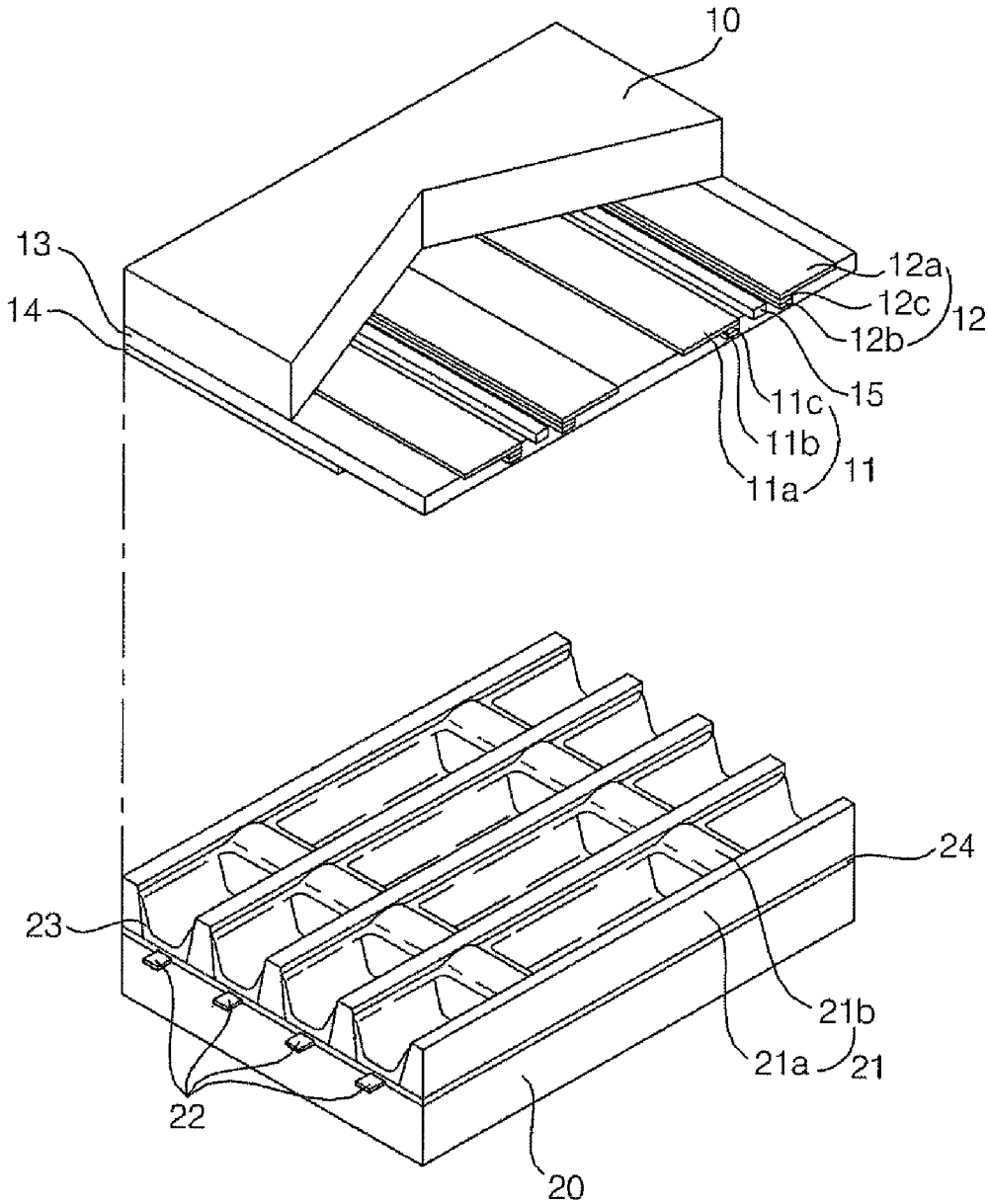
FIG. 1 is a perspective view illustrating the structure of a plasma display panel (PDP) according to an embodiment of the present invention.

Hereinafter, a plasma display device according to the present invention will be described in detail with reference to the attached drawings. FIG. 1 is a perspective view illustrating the structure of a plasma display panel (PDP) according to an embodiment of the present invention.

As illustrated in FIG. 1, the PDP includes a scan electrode 11 and a sustain electrode 12 that are a pair of sustain electrodes formed on a top substrate 10 and address electrodes formed on a bottom substrate 20.

The pair of sustain electrodes 11 and 12 include transparent electrodes 11*a* and 12*a* and bus electrodes 11*b* and 12*b* that are formed of indium tin oxide (ITO). The bus electrodes 11*b* and 12*b* can be formed of a metal such as Ag and Cr or a laminated structure of Cr/Cu/Cr or a laminated structure of Cr/Al/Cr. The bus electrodes 11*b* and 12*b* are formed on the transparent electrodes 11*a* and 12*a* to reduce a voltage reduction caused by the transparent electrodes 11*a* and 12*a* having high resistance.

On the other hand, according to an embodiment of the present invention, the pair of sustain electrodes 11 and 12 can be formed by laminating the transparent electrodes 11*a* and 12*a* and the bus electrodes 11*b* and 12*b* and can be formed of only the bus electrodes 11*b* and 12*b* without the transparent electrodes 11*a* and 12*a*. In such a structure, since the transparent electrodes 11*a* and 12*a* are not used, the manufacturing cost of the PDP can be reduced. The bus electrodes 11*b* and 12*b* having such a structure can be formed of various materials such as photosensitive materials.

A black matrix (BM) 15 that absorbs external light generated in the outside of the top substrate 10 to reduce reflection and that improves the purity and the contrast of the top substrate 10 is provided between the transparent electrodes 11*a* and 12*a* and the bus electrodes 11*b* and 11*c* of the scan electrode 11 and the sustain electrode 12.

The BM 15 according to an embodiment of the present invention formed on the top substrate 10 can include a first BM 15 formed to overlap barrier ribs 21 and second BMs 11*c* and 12*c* formed between the transparent electrodes 11*a* and 12*a* and the bus electrodes 11*b* and 12*b*. Here, the first BM 15 and the second BMs 11*c* and 12*c* referred to as black layers or black electrode layers can be simultaneously formed to be physically connected to each other or may not be simultaneously formed not to be physically connected to each other.

In addition, when the first BM 15 and the second BMs are physically connected to each other, the first BM 15 and the second BMs 11*c* and 12*c* are formed of the same material. However, when the first BM 15 and the second BMs are physically separated from each other, the first BM 15 and the second BMs can be formed of different materials.

An upper dielectric layer 13 and a protective layer 14 are laminated on the upper substrate 10 where the scan electrode 11 and the sustain electrode 12 are formed in parallel. Charged particles generated by discharge are accumulated on the upper dielectric layer 13 to protect the pair of sustain electrodes 11 and 12. The protective layer 14 protects the upper dielectric layer 13 against the sputtering of the charged particles generated during gas discharge and improves the emission efficiency of secondary electrons.

In addition, the address electrodes 22 are formed to intersect the scan electrode 11 and the sustain electrode 12. In addition, a lower dielectric layer 24 and the barrier ribs 21 are formed on the lower substrate 20 where the address electrodes 22 are formed.

In addition, phosphor layers 23 are formed on the surfaces of the lower dielectric layer 24 and the barrier ribs 21. In the barrier ribs 21, vertical barrier ribs 21*a* and horizontal barrier ribs 21*b* are formed to be closed. The barrier ribs 21 physically partition off discharge cells and prevent UV rays and visible rays generated by the discharge from leaking to adjacent discharge cells.

According to an embodiment of the present invention, various shaped barrier ribs 21 as well as the barrier ribs 21 illustrated in FIG. 1 can be formed. For example, differential barrier ribs in which the height of the vertical barrier ribs 21*a* is different from the height of the horizontal barrier ribs 21*b*, channel type barrier ribs in which channels that can be used as air discharging paths are formed in at least one of the vertical barrier ribs 21*a* and the horizontal barrier ribs 21*b*, and hollow type barrier ribs in which hollows are formed in at least one of the vertical barrier ribs 21*a* and the horizontal barrier ribs 21*b* can be formed.

Here, in the differential barrier ribs, the height of the horizontal barrier ribs 21*b* is preferably higher than the height of the vertical barrier ribs 21*a*. In the channel type barrier ribs and the hollow type barrier ribs, the channels and the hollows are preferably formed in the horizontal barrier ribs 21*b*.

On the other hand, according to an embodiment of the present invention, it is described that the R, G, and B discharge cells are arranged on the same line. However, the R, G, and B can be arranged in different shapes. For example, delta type arrangement in which the R, G, and B discharge cells are triangularly arranged can be provided. In addition, the discharge cells can be polygonal such as square, pentagonal, and hexagonal.

In addition, the phosphor layers 23 emit light by the UV rays generated during the gas discharge to generate one visible ray among red R, green G, and blue B visible rays. Here, an inert gas mixture such as He+Xe, Ne+Xe, and He+Ne+Xe for discharge is injected into discharge spaces provided between the top and bottom substrates 10 and 20 and the barrier ribs 21.

Figure 2:
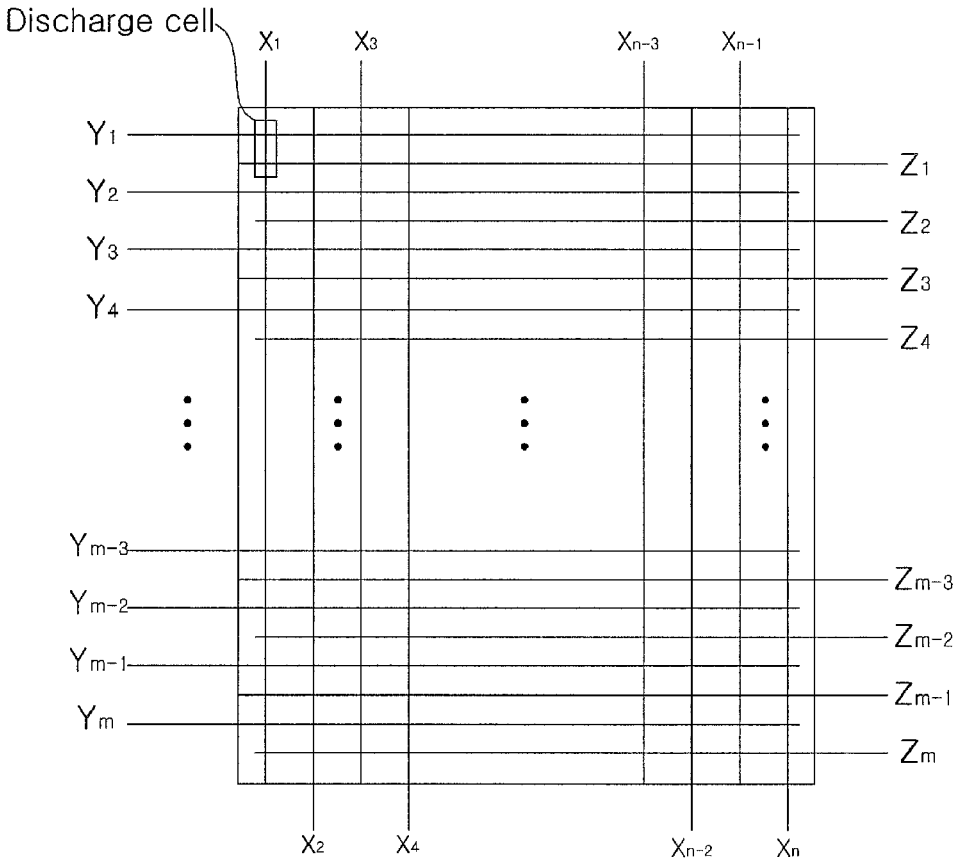
FIG. 2 illustrates the arrangement of the electrodes of the PDP according to an embodiment of the present invention.

FIG. 2 illustrates the arrangement of the electrodes of the PDP according to an embodiment of the present invention. As illustrated in FIG. 2, the plurality of discharge cells that constitute the PDP are preferably arranged in a matrix. The plurality of discharge cells are provided in the intersections of scan electrode lines Y1 to Ym, sustain electrode lines Z1 to Zm, and address electrode lines X1 to Xn. The scan electrode lines Y1 to Ym can be sequentially or simultaneously driven. The sustain electrode lines Z1 to Zm can be simultaneously driven. The address electrode lines X1 to Xn can be divided into odd lines and even lines to be driven or can be sequentially driven.

Since the electrode arrangement illustrated in FIG. 2 is only an embodiment of the electrode arrangement of the PDP according to the present invention. The present invention is not limited to the electrode arrangement and the driving method of the PDP illustrated in FIG. 2. For example, a dual scanning method in which two scan electrode lines among the scan electrode lines Y1 to Ym are simultaneously scanned can be provided. In addition, the address electrode lines X1 to Xn can be divided up and down or side to side in the center of the PDP to be driven.

Figure 3:
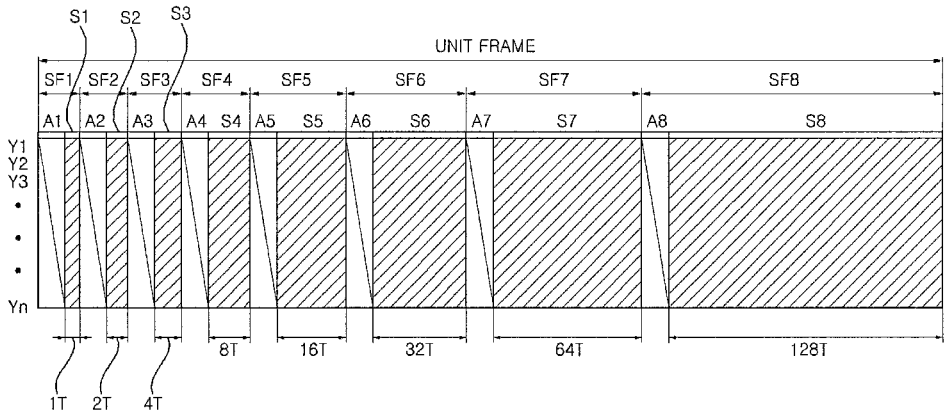
FIG. 3 is a timing diagram illustrating a method of time division driving the PDP by dividing one frame into a plurality of subfields according to an embodiment of the present invention.

FIG. 3 is a timing diagram illustrating a method of time division driving the PDP by dividing one frame into a plurality of subfields according to an embodiment of the present invention. A unit frame can be divided into a predetermined number of, for example, eight subfields SF1, . . . , and SF8 in order to display time division gray scales. In addition, each subfield SF1, . . . , and SF8 is divided into a reset period (not shown), address periods A1, . . . , and A8, and sustain periods S1, . . . , and S8.

Here, according to an embodiment of the present invention, the reset period can be omitted in at least one among the plurality of subfields. For example, the reset period can exist only in the initial subfield or only in an intermediate subfield among all of the subfields.

In the address periods A1, . . . , and A8, display data signals are applied to the address electrodes X and scan pulses corresponding to the scan electrodes Y are sequentially applied.

In the sustain periods S1, . . . , and S8, sustain pulses are alternately applied to the scan electrodes Y and the sustain electrodes Z so that sustain discharge is generated in discharge cells where wall charges are formed in the address periods A1, . . . , and A8.

The brightness of the PDP is in proportion to the number of sustain discharge pulses in the sustain discharge periods S1, . . . , and S8 occupied in the unit frame. When one frame that forms an image is displayed by the eight subfields and 256 gray scales, different numbers of sustain pulses can be assigned to the subfields, respectively, in the rate of 1, 2, 4, 8, 16, 32, 64, and 128. In order to obtain the brightness of 133 gray scales, cells in a subfield 1 period, a subfield 3 period, and a subfield 8 period are addressed to perform sustain discharge.

The number of sustain discharges assigned to each subfield can vary in accordance with the weight values of the subfields in accordance with an automatic power control (APC) step. That is, in FIG. 3, one frame is divided into the eight subfields. However, the present invention is not limited to the above. The number of subfields that form one frame can vary in accordance with a design specific. For example, one frame can be divided into no less than the eight subfields such as 12 or 16 subfields to drive the PDP.

In addition, the number of sustain discharges assigned to each subfield can vary in consideration of a gamma characteristic or a panel characteristic. For example, the gray scale level assigned to the subfield 4 can be reduced from 8 to 6 and the gray scale level assigned to the subfield 6 can be increased from 32 to 34.

Figure 4:
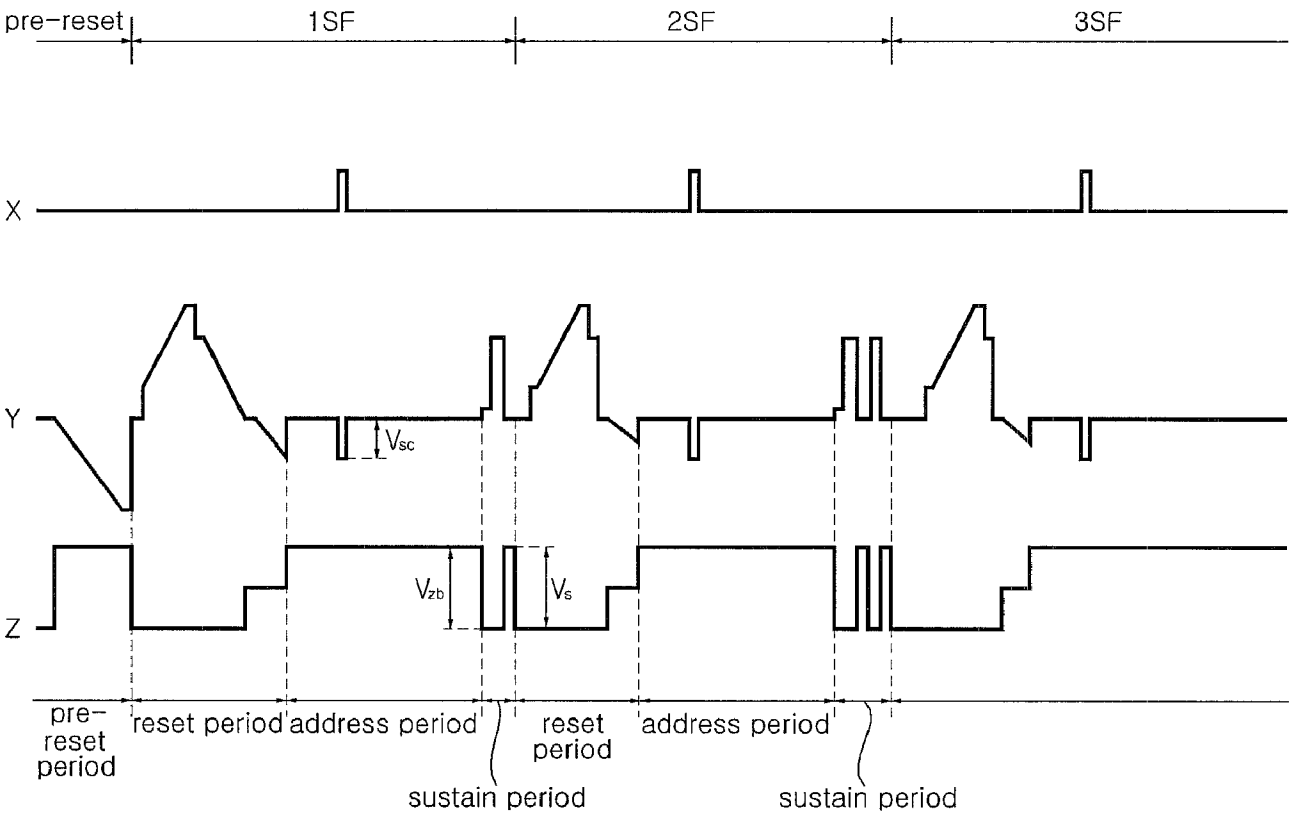
FIG. 4 is a timing diagram illustrating the shapes of driving signals for driving the PDP according to an embodiment of the present invention.

FIG. 4 is a timing diagram illustrating the shapes of driving signals for driving the PDP according to an embodiment of the present invention.

The subfield can include a pre-reset period for forming positive polar wall charges on the scan electrodes Y and for forming negative polar wall charges on the sustain electrodes Z, a reset period for initializing the discharge cells of an entire screen using the distribution of wall charges formed in the pre-reset period, an address period for selecting the discharge cells, and a sustain period for sustaining the discharge of the selected discharge cells.

The reset period includes a set up period and a set down period. In the set up period, rising ramp shapes Ramp-up are simultaneously applied to all of the scan electrodes in the set up period so that fine discharge is generated in all of the discharge cells and that the wall charges are generated. In the set down period, falling ramp shapes Ramp-down that fall from a positive polar voltage lower than the peak voltage of the rising ramp shapes Ramp-up are simultaneously applied to all of the scan electrodes Y so that erase discharge is generated in all of the discharge cells to erase the wall charges generated by set up discharge and unnecessary charges among spatial charges.

In the address period, scan signals having a negative polar scan voltage Vsc are sequentially applied to the scan electrodes and positive polar data signals are applied to the address electrodes X. Address discharge is generated by a voltage difference between the scan signals and the data signals and a wall voltage generated in the reset period to select cells. On the other hand, in order to improve the efficiency of the address discharge, a sustain bias voltage Vzb is applied to the sustain electrodes in the address period.

In the address period, the plurality of scan electrodes Y are divided into at least two groups so that the scan signals can be sequentially supplied to the groups. Each of the divided groups is divided into at least two subgroups so that the scan signals can be sequentially supplied to the subgroups. For example, the plurality of scan electrodes Y are divided into a first group and a second group. Then, after the scan signals are sequentially supplied to the scan electrodes that belong to the first group, the scan signals can be sequentially supplied to the scan electrodes that belong to the second group.

According to an embodiment of the present invention, the plurality of scan electrodes Y can be divided into a first group that includes even scan electrodes and a second group that includes odd scan electrodes in accordance with the positions on the PDP. According to another embodiment of the present invention, the plurality of scan electrodes Y can be divided into a first group that includes scan electrodes positioned on the upper side and a second group that includes scan electrodes positioned on the lower side based on the center of the PDP.

The scan electrodes that belong to the first group divided by the above method can be divided into a first subgroup that includes even scan electrodes and a second subgroup that includes odd scan electrodes or can be divided into a first subgroup that includes scan electrodes positioned on the upper side and a second group that includes scan electrodes positioned on the lower side based on the center of the PDP.

In the sustain period, the sustain pulses having a sustain voltage Vs are alternately applied to the scan electrodes and the sustain electrodes so that the sustain discharge is generated between the scan electrodes and the sustain electrodes in a surface discharge type.

Among the plurality of sustain signals alternately supplied to the scan electrodes and the sustain electrodes in the sustain period, the width of the first sustain signal or the width of the final sustain signal can be larger than the width of the other sustain pulses.

After the sustain discharge is generated, an erase period in which the scan electrodes of on cells selected in the address period or the wall charges that remain in the sustain electrodes are erased by generating weak discharge can be further included after the sustain period.

The erase period can be included all of the plurality of subfields or partial subfields. Erase signals for the weak discharge are preferably applied to electrodes where the final sustain pulse is not applied in the sustain period.

Gradually increasing ramp shaped signals, low voltage wide pulses, high voltage narrow pulses, exponential signals or half sinusoidal pulses can be used as the erase signals.

In addition, a plurality of pulses can be sequentially applied to the scan electrodes or the sustain electrodes in order to generate the weak discharge.

The driving shapes illustrated in FIG. 4 are only an embodiment of signals for driving the PDP according to the present invention. The present invention is not limited to the shapes illustrated in FIG. 4. For example, the pre-reset period can be omitted, the polarities and the voltage levels of the driving signals illustrated in FIG. 4 can be changed if necessary, erase signals for erasing the wall charges can be applied to the sustain electrodes after the sustain discharge is completed. In addition, single sustain driving in which the sustain signals are applied to only one of the scan electrodes Y and the sustain electrodes Z to generate the sustain discharge can be performed.

Figure 5:
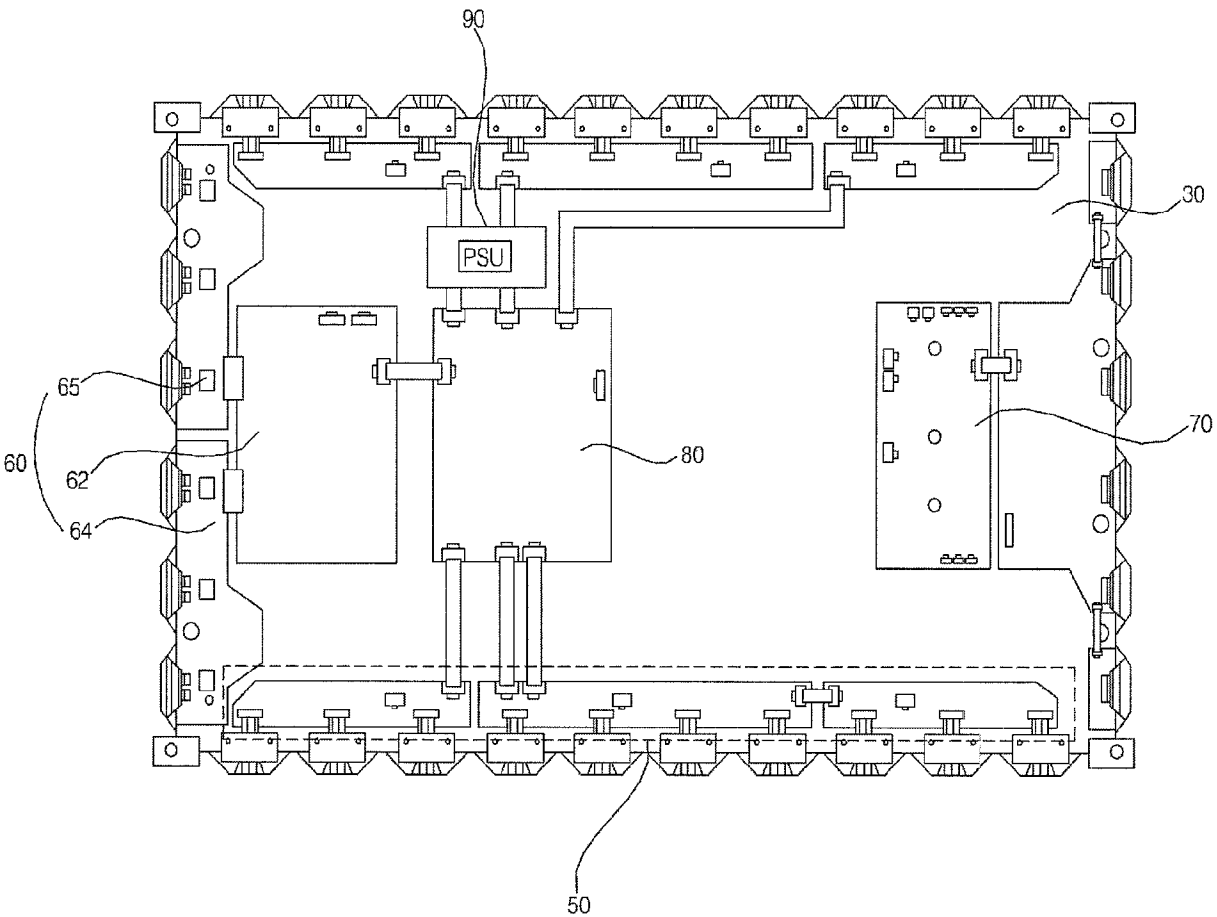
FIG. 5 illustrates the structure of a device for driving the PDP according to an embodiment of the present invention.

FIG. 5 illustrates the structure of a device for driving the PDP according to an embodiment of the present invention.

Referring to FIG. 5, a heat discharging frame 30 is provided on the rear surface of the PDP to support the PDP and to absorb heat generated by the PDP and then, to discharge the generated heat. In addition, printed circuit boards (PCB) that apply the driving signals to the PDP are provided on the rear surface of the heat discharging frame 30.

A PCB 40 includes an address driver 50 for supplying driving signals to the address electrodes of the PDP, a scan driver 60 for supplying driving signals to the scan electrodes of the PDP, a sustain driver 70 for supplying driving signals to the sustain electrodes of the PDP, a driving controller 80 for controlling the driving circuits, and a power supply unit (PSU) 90 for supplying a power source to driving circuits, respectively.

The address driver 50 supplies the driving signals to the address electrodes formed on the PDP to select only discharged discharge cells among the plurality of discharge cells formed on the PDP.

The address driver 50 can be provided in one or all of the upper side and the lower side of the PDP in accordance with a single scan method or a dual scan method.

A data integrated circuit (not shown) is provided in the address driver 50 to control current applied to the address electrodes. Switching is generated in the data IC to control the applied current so that a large amount of heat can be generated. Therefore, a heat sink (not shown) can be provided in the address driver 50 in order to discharge the heat generated in the controlling process.

As illustrated in FIG. 5, the scan driver 60 can include a scan sustain board 62 connected to the driving controller 80 and a scan driver board 64 for connecting the scan sustain board 62 to the PDP.

The scan driver board 64 can be divided into the upper side and the lower side. One scan driver board 64 can be provided or a plurality of scan driver boards 64 can be provided as illustrated in FIG. 5.

A scan IC 65 for supplying the driving signals to the scan electrodes of the PDP is provided in the scan driver board 64. The scan IC 65 can continuously apply reset, scan, and sustain signals to the scan electrodes.

The sustain driver 70 supplies the driving signals to the sustain electrodes of the PDP.

The driving controller 80 performs predetermined signal processing for input image signals using signal processing information stored in a memory to convert the image signals into data to be supplied to the address electrodes and aligns the converted data in accordance with a scanning order. In addition, the driving controller 80 supplies timing control signals to the address driver 50, the scan driver 60, and the sustain driver 70 to control the driving signal supplying points of time of the driving circuits.

Figure 6:
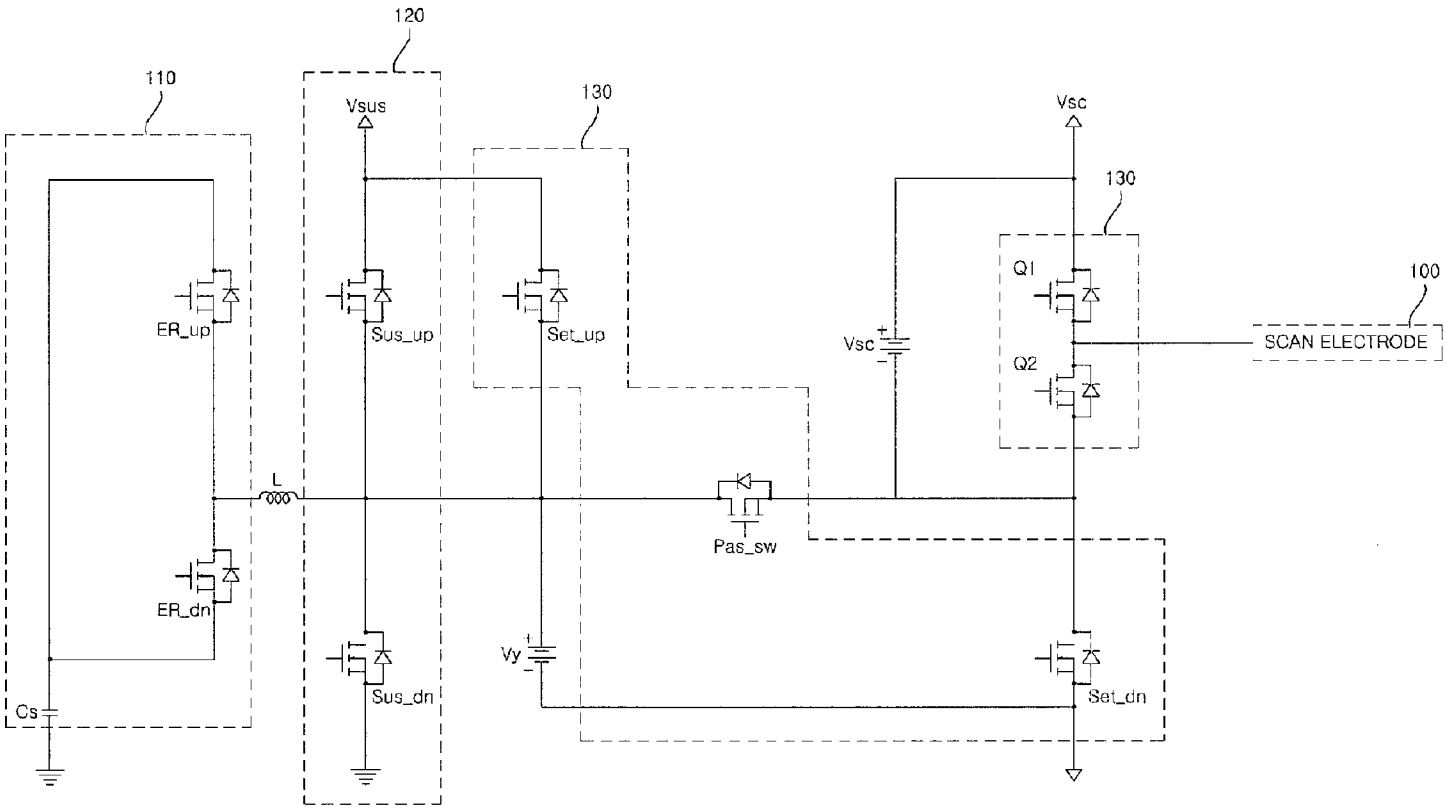
FIG. 6 is a circuit diagram illustrating a scan driver for supplying driving signals to the scan electrodes of the PDP.

FIG. 6 is a circuit diagram illustrating a scan driver for supplying driving signals to the scan electrodes of the PDP. The scan driving circuit includes an energy recovery unit 110, a sustain driver 120, a reset driver 130, and a scan IC 140.

The sustain driver 120 includes a sustain voltage power source Vsus for supplying a high potential sustain voltage Vsus in the sustain period, a sus-up switch Sus_up turned on so that a sustain voltage Vsus is applied to the scan electrodes 10, and a sus-down switch Sus_dn turned on so that a voltage applied to the scan electrode 10 is reduced to a ground voltage. That is, in the sustain driver 120, the sus-up switch Sus_up is connected to the sustain voltage Vsus power source and the sus-down switch Sus_dn is connected to the sus-up switch Sus_up and a ground.

The energy recovery unit 110 includes a source capacitor Cs for recovering energy supplied to a scan electrode 100 to store the energy, an energy supply switch ER_up turned on so that the energy stored in the source capacitor Cs is supplied to the scan electrode 100, and an energy recovery switch ER_dn turned on so that the energy is recovered from the scan electrode 100. The source capacitor Cs forms a resonance circuit together with an inductor L to supply energy to and recover energy from the electrode 100.

The reset driver 130 includes a set up switch Set_up turned on in order to supply gradually increasing set up signals to the scan electrode 100, a set down switch Set_dn connected to a voltage source Vy and turned on so that set down signals that gradually fall to a negative polar voltage −Vy to the scan electrode 100, and a pass switch Pass_sw for forming a current pass channel together with the scan electrode 100.

As illustrated in FIG. 6, in the set up switch Set_up, a drain Drain is connected to a sustain voltage power source, a source Source is connected to the pass switch pass_sw, and a gate Gate is connected to a variable resistor (not shown). The set up signals that gradually rise in accordance with a change in the resistance value of the variable resistor are generated by the set up switch Set_up.

In the set down switch Set_dn, a drain Drain is connected to the scan IC 50, a source Source is connected to the negative polar voltage −Vy, and a gate Gate is connected to the variable resistor (not shown). The set down signals that gradually fall in accordance with a change in the resistance value of the variable resistor (not shown) are generated by the set down switch Set_up.

The san IC 140 includes a scan up switch Q1 connected to a scan voltage power source turned on in order to apply a scan voltage Vsc to the scan electrode and a scan down switch Q2 turned on in order to apply a ground voltage to the scan electrode 100.

In the scan driver illustrated in FIG. 6, a large capacity of pass switch Pass_se is used so that the manufacturing cost of the driving circuit can increase and power consumption in accordance with switching can increase.

Figure 7:
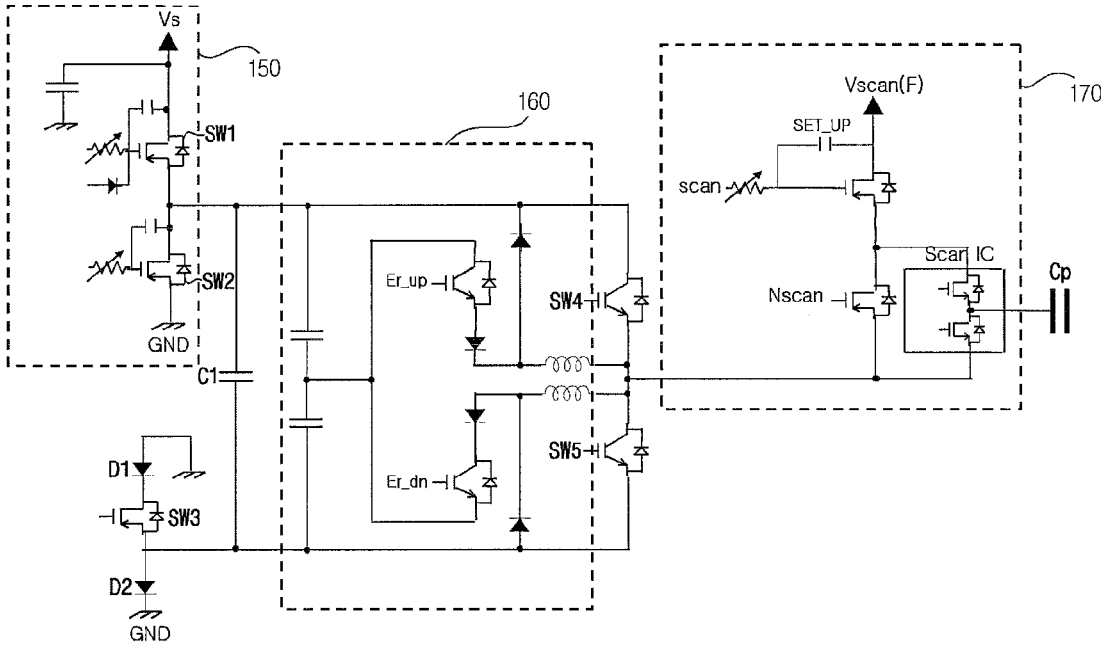
FIG. 7 is a circuit diagram illustrating the structure of a scan driver according to a first embodiment of the present invention.

FIG. 7 is a circuit diagram illustrating the structure of a scan driver according to a first embodiment of the present invention. The scan driver includes a sustain voltage applier 150, an energy recovery unit 160, a reset driver 170, and a scan IC.

The sustain voltage applier 150 includes a sustain voltage Vs power source for supplying a high potential sustain voltage Vs in the reset period and in the sustain period, a first switch SW1 turned on so that the sustain voltage Vs is applied to the scan electrodes, and a second switch SW2 turned on so that the voltage applied to the scan electrodes is reduced to the ground voltage. At this time, in order to make the output of the sustain voltage applier 150 gradually increase and fall to the sustain voltage, the first switch SW1 is connected to a positive slope signal generator consisting of a variable resistor and a capacitor and the second switch SW2 is connected to a negative slope signal generator.

In addition, a first capacitor C1 whose one end is connected to the output end of the sustain voltage applier 150 and a third switch SW3 connected to the other end of the first capacitor C1 and turned on so that the ground voltage GND is applied to a panel capacitor Cp when the output of the other end is negative-polar are further included.

The energy recovery unit 160 includes source capacitors that recover and supply energy supplied to the scan electrodes, an energy supply switch Er_up turned on so that the energy recovered by the source capacitor to be stored in the source capacitor is supplied to the scan electrode, an energy recovery switch Er_dn turned on so that energy is recovered from the scan electrode, and inductors that form a resonance circuit together with the panel capacitor Cp.

The reset driver 170 includes a set up switch turned on in order to supply the gradually rising set up signals to the scan electrode and a scan IC. The scan IC includes a scan up switch connected to the scan voltage Vscan power source and turned on to apply the scan voltage Vsc to the scan electrode and a scan down switch turned on in order to apply the ground voltage to the scan electrode.

Figure 8:
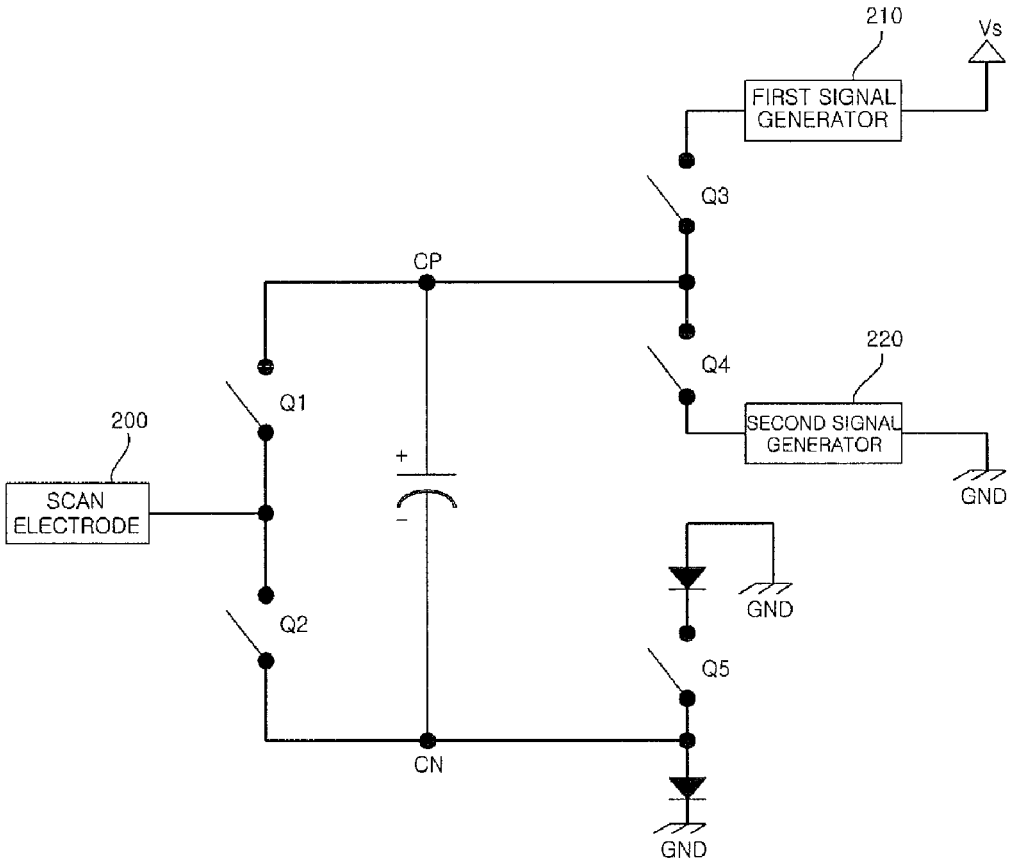
FIG. 8 is a circuit diagram illustrating the structure of a scan driver according to a second embodiment of the present invention.

FIG. 8 is a circuit diagram illustrating the structure of a scan driver according to a second embodiment of the present invention. Referring to FIG. 8, according to the present invention, the output end of the sustain voltage source 150 illustrated in FIG. 7 can be connected to the first end CP of the first capacitor C1. In addition, the second end CN of the first capacitor C1 can be connected to the third switch SW3 to selectively apply the ground voltage.

At this time, a voltage difference between both ends of the first capacitor C1 can be previously set as a predetermined voltage and the voltage difference between the both ends can be the sustain voltage Vs. In such a case, the signals that rise to the sustain voltage in the reset period and the sustain period can be realized.

In addition, according to the present invention, the outputs of the both ends of the first capacitor C1 are applied to the panel capacitor to form the driving signals. Therefore, a first switch Q1 turned on in order to apply the output of the first end SP of the first capacitor C1 to the scan electrode 200 and a second switch Q2 turned on in order to apply the output of the second end SN of the first capacitor C1 to a scan electrode 200 are provided.

As described above, in the scan driver according to the present invention, the conventional driving shapes can be reduced although the pass switch provided in the conventional scan driver and the negative polar scan voltage source −Yy to be applied to the scan electrodes in the address period are not additionally provided so that the manufacturing cost can be reduced.

Figure 9:
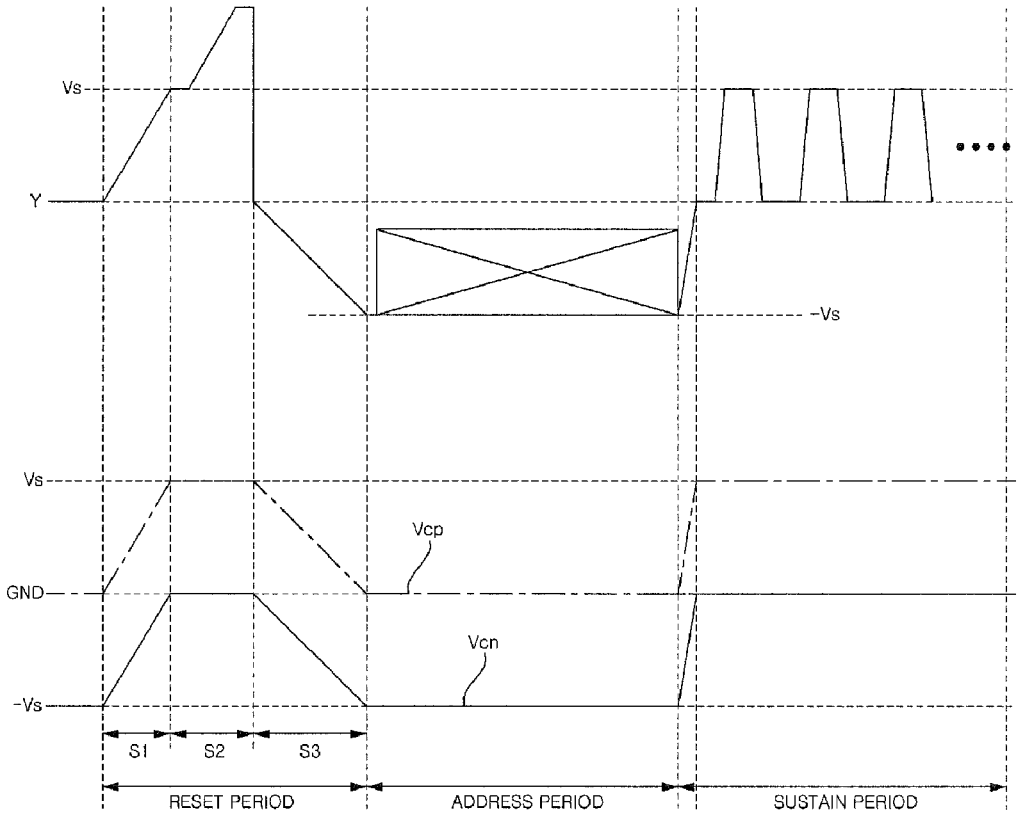
FIG. 9 is a timing diagram illustrating the shapes of the driving signals supplied to the scan electrodes according to an embodiment of the present invention.

FIG. 9 is a timing diagram illustrating the shapes of the driving signals supplied to the scan electrodes according to an embodiment of the present invention. The operations of the scan driver according to the present invention for supplying the driving signal shapes illustrated in FIG. 9 will be described with reference to FIGS. 10 to 14.

Referring to FIG. 9, a voltage supplied to the scan electrodes Y in the set up period of the reset period gradually increases from the ground voltage GND and a voltage supplied to the scan electrodes Y in the first set up period s1 of the set up period can gradually increase from the ground voltage GND to the sustain voltage Vs.

Before the reset period, in order to make the ground voltage output to the panel capacitor Cp, the second switch Q2 and the fourth switch Q4 of a sustain voltage applier 100 are turned on and the first switch Q1 and the third switch Q3 of the sustain voltage applier 100 are turned off.

Figure 10:
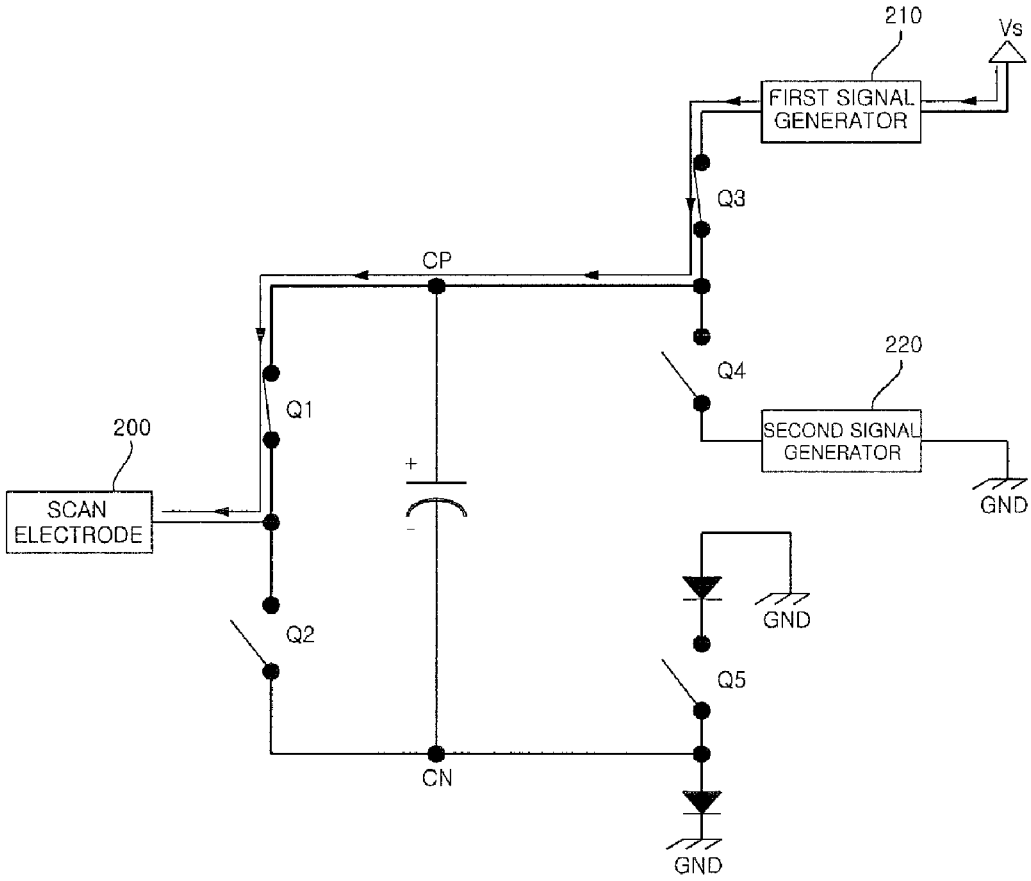
FIGS. 10 to 14 are circuit diagrams illustrating the operations of the scan driver according to embodiments of the present invention.

Referring to FIG. 10, in order to supply signals that gradually rise to the positive polar sustain voltage Vs in the first set up period s1 to the scan electrode 200, the first switch Q1 and the third switch Q3 are turned on and the second switch Q2 and the fourth switch Q4 are turned off.

Therefore, the signal that gradually rises to the sustain voltage that is output from a first signal generator 210 that is the positive slope signal generator is supplied to the first end CP of the first capacitor C1.

That is, as illustrated in FIG. 9, the voltage of the first end CP of the first capacitor C1 gradually increases from the ground voltage GND to the positive polar sustain voltage Vs in the first set up period s1. Therefore, the voltage of the second end CN gradually increases from the negative polar sustain voltage −Vs to the ground voltage GND.

At this time, since the first switch Q1 is turned on, the voltage of the first end CP of the first capacitor C1 is supplied to the scan electrode 200 so that the driving signals supplied to the scan electrode 200 gradually rise from the ground voltage GND to the positive polar sustain voltage Vs.

Referring to FIG. 9, a voltage supplied to the scan electrodes Y in the set down period s3 of the reset period can be gradually reduced from the ground voltage GND.

Figure 11:
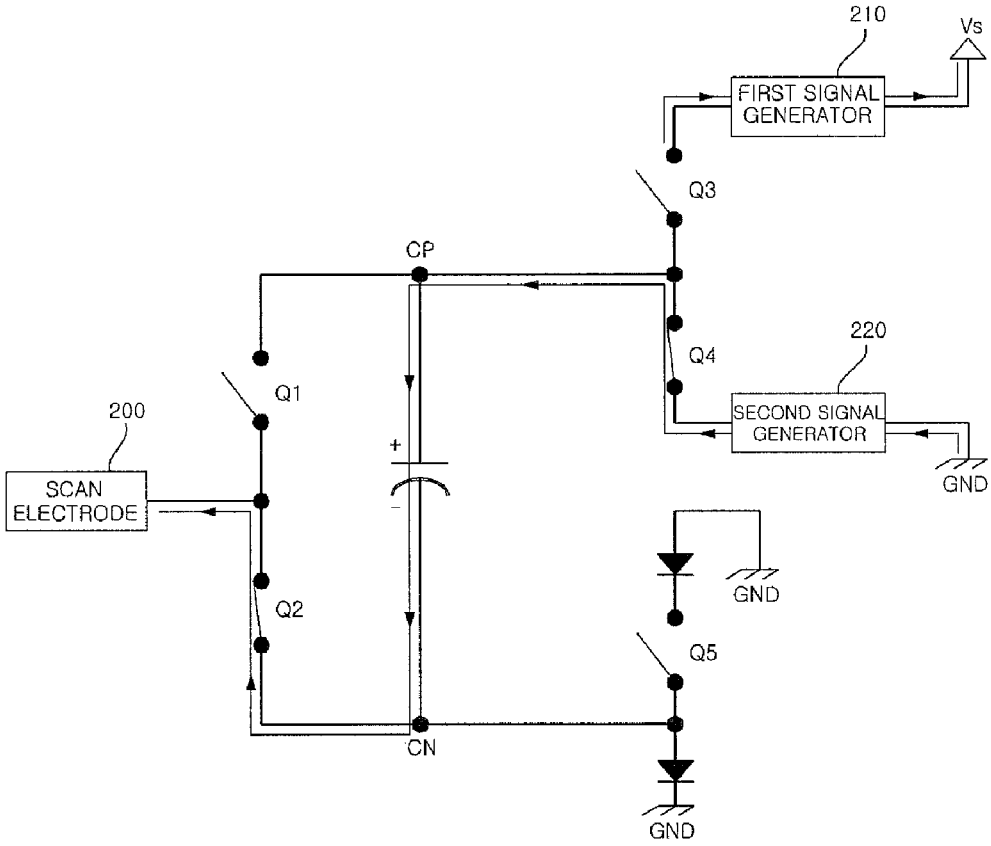

Referring to FIG. 11, in the set down period s3, the second switch Q2 and the fourth switch Q4 are turned on and the first switch Q1 and the third switch Q3 are turned off.

Therefore, a signal that gradually falls by the sustain voltage Vs that is output from a second signal generator 220 that is a negative slope signal generator is supplied to the first end CP of the first capacitor C1.

That is, as illustrated in FIG. 9, the voltage of the first end CP of the first capacitor C1 is gradually reduced from the sustain voltage Vs to the ground voltage GND in the set down period s3 so that the voltage of the second end CN is gradually reduced from the ground voltage GND to the negative polar sustain voltage −Vs.

At this time, since the second switch Q2 is turned on, the voltage of the second end CN of the first capacitor C1 is supplied to the scan electrode 200 so that the driving signals supplied to the san electrode 200 gradually fall from the ground voltage GND to the negative polar sustain voltage −Vs.

Figure 12:
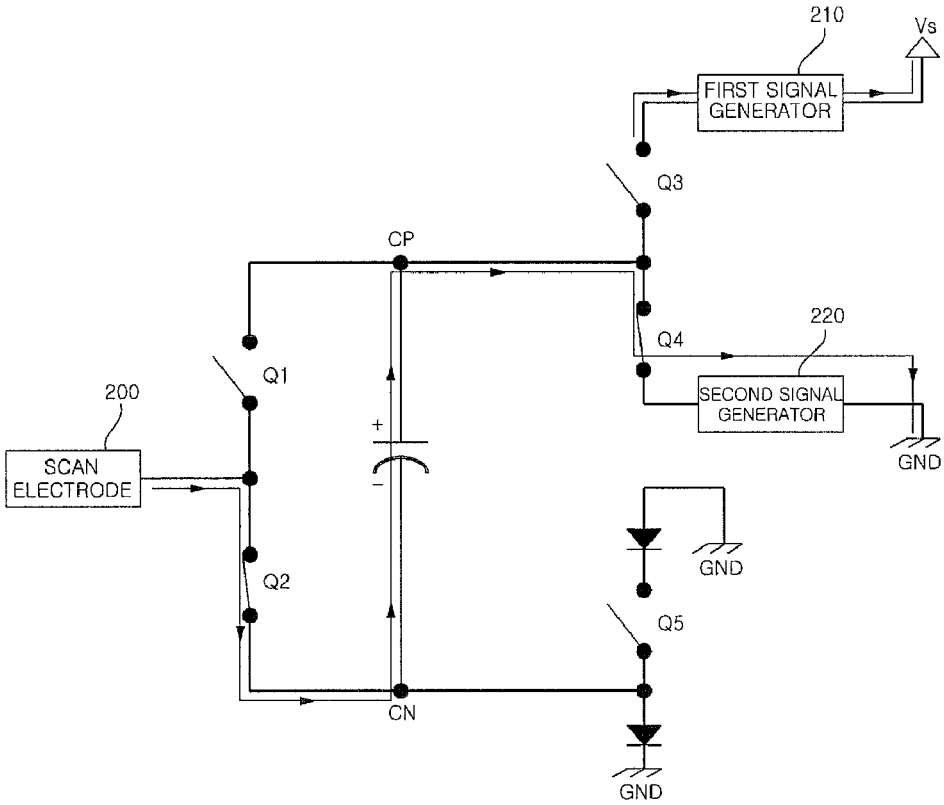

Referring to FIG. 12, the second switch Q2 and the fourth switch Q4 are turned on in the address period so that the voltage of the first end CP of the first capacitor has the ground voltage GND and that the voltage of the second end CN has the negative polar sustain voltage-Vs.

At this time, the second switch Q2 is turned on so that the negative sustain voltage −Vs is supplied to the scan electrode 200 as a scan bias voltage.

Figure 13:
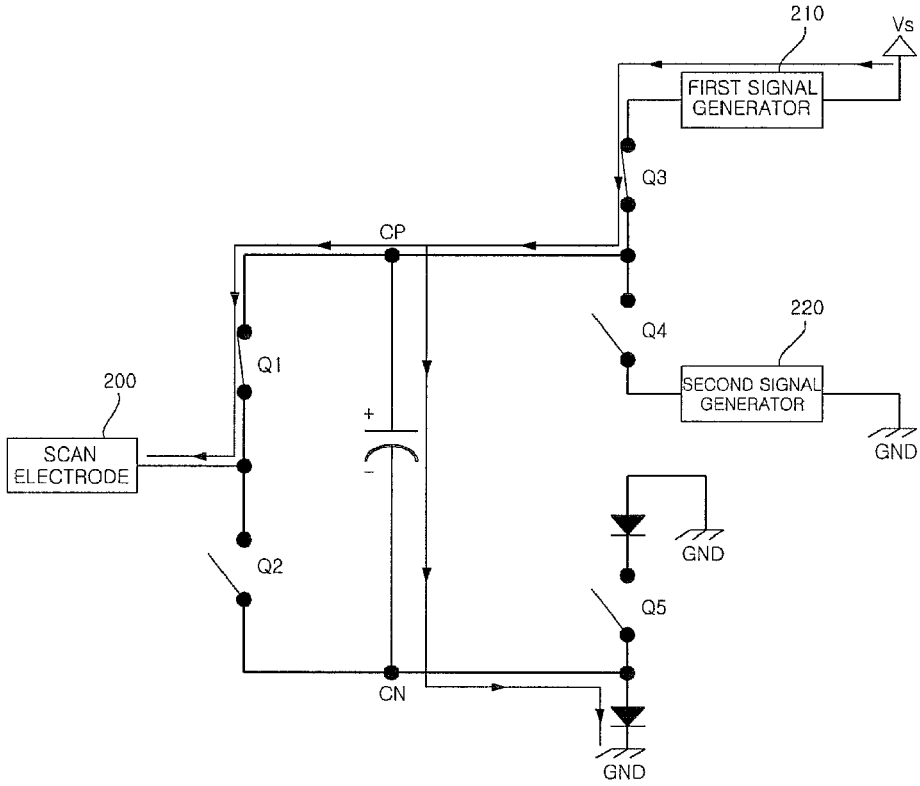

Referring to FIG. 13, the third switch Q3 is turned on and the fourth switch Q4 is turned off in the sustain period. Therefore, as illustrated in FIG. 9, the voltage of the first end CP of the first capacitor has the positive polar sustain voltage Vs and the voltage of the second end CN has the ground voltage GND.

In addition, the first switch Q1 is turned on so that the sustain voltage Vs that is the voltage of the first end CP of the first capacitor is supplied to the scan electrode 200.

Figure 14:
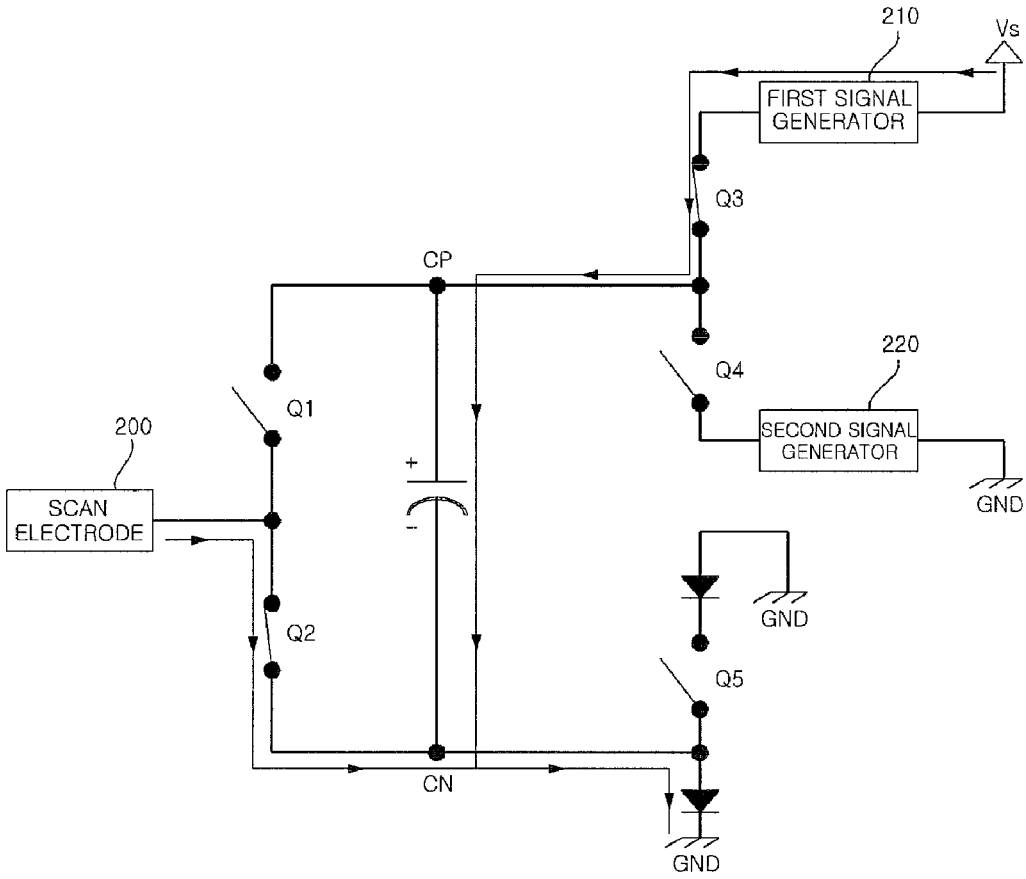

Referring to FIG. 14, after the sustain voltage Vs is supplied to the scan electrode 200 in the sustain period, the second switch Q2 is turned on so that the ground voltage GND that is the voltage of the second end CN of the second capacitor is supplied to the scan electrode 200.

As described above, in a state where the third switch Q3 is turned on and the fourth switch Q4 is turned off, the first switch Q1 and the second switch Q2 are alternately turned on so that the plurality of sustain signals illustrated in FIG. 9 can be supplied to the scan electrode 200.

In the plasma display device according to the present invention having the above-described structure, since the conventional large capacity of pass switch and the negative polar scan voltage source −Yy are replaced by cheap capacitors with the driving signals for driving the PDP applied in the same way, it is possible to reduce the manufacturing cost of the plasma display device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display device comprising:

a plasma display panel (PDP) and drivers for supplying driving signals to the PDP, wherein the driver comprises:

a capacitor;

a first switch connected to a first end of the capacitor and turned on in order to supply a voltage of the first end of the capacitor to the PDP;

a second switch connected to a second end of the capacitor and turned on in order to supply a voltage of the second end of the capacitor to the PDP;

a first voltage supplier connected to the first end of the capacitor to supply one of a sustain voltage and a reference voltage to the first end of the capacitor; and a second voltage supplier connected to the second end of the capacitor to supply the reference voltage to the second end of the capacitor, wherein a voltage difference between the both ends of the capacitor is sustained as the sustain voltage, and wherein the first voltage supplier comprises:

a third switch connected to the first end of the capacitor and turned on in order to supply the sustain voltage to the first end of the capacitor; and a fourth switch directly connected to the first end of the capacitor and turned on in order to supply the reference voltage to the first end of the capacitor.

2. The plasma display device as claimed in claim 1, wherein the first voltage supplier further comprises:

a first signal generator connected to the third switch to generate a signal that gradually rises to the sustain voltage; and a second signal generator connected to the fourth switch to generate a signal that gradually falls to the reference voltage.

3. The plasma display device as claimed in claim 2, wherein the first switch and the third switch are turned on so that the signal that gradually rises is supplied to the PDP in a set up period of a reset period.

4. The plasma display device as claimed in claim 1, wherein the voltage of the first end of the capacitor gradually rises from the reference voltage to the sustain voltage in a set up period of a reset period.

5. The plasma display device as claimed in claim 2, wherein the second switch and the fourth switch are turned on so that the signal that gradually falls is supplied to the PDP in a set down period of a reset period.

6. The plasma display device as claimed in claim 1, wherein the voltage of the second end of the capacitor is gradually reduced from the reference voltage to a negative polarity voltage in a set down period of a reset period, and wherein an absolute value of the negative polarity voltage is equal to an absolute value of the sustain voltage.

7. The plasma display device as claimed in claim 1, wherein the second switch and the fourth switch are turned on so that the reference voltage is supplied to the PDP in an address period.

8. The plasma display device as claimed in claim 1, wherein the first switch and the third switch are turned on so that the sustain voltage is supplied to the PDP in a sustain period.

9. The plasma display device as claimed in claim 1, wherein the second voltage supplier comprises a fifth switch turned on in order to supply the reference voltage.

10. The plasma display device as claimed in claim 9, wherein the second voltage supplier further comprises:

a first diode having an anode end connected to the second end of the capacitor and having a cathode end connected to a reference voltage source; and a second diode having a cathode end connected to the fifth switch and having an anode end connected to the reference voltage source.

11. The plasma display device as claimed in claim 1, wherein the voltage of the first end of the capacitor is higher than the voltage of the second end of the capacitor.

12. A plasma display device comprising:

a plasma display panel (PDP), and a scan driver for supplying driving signals to scan electrodes formed on a top substrate of the PDP, wherein the scan driver comprises:

a capacitor;

a first switch connected to a first end of the capacitor and the first switch is turned on in order to supply a voltage of the first end of the capacitor to the scan electrodes;

a second switch connected to a second end of the capacitor and the second switch is turned on in order to supply a voltage of the second end of the capacitor to the scan electrodes; and a first voltage supplier for supplying one of a first signal that gradually rises from the first end of the capacitor to a sustain voltage and a second signal that gradually falls to a reference voltage, wherein a voltage difference between the first end of the capacitor and the second end of the capacitor is sustained as a sustain voltage, and wherein the first voltage supplier comprises:

a third switch connected to the first end of the capacitor and the third switch is turned on in order to supply the sustain voltage to the first end of the capacitor; and a fourth switch directly connected to the first end of the capacitor and the fourth switch is turned on in order to supply the reference voltage to the first end of the capacitor.

13. The plasma display device as claimed in claim 12, wherein the first voltage supplier further comprises:

a first signal generator connected to the third switch to generate the first signal;

a second signal generator connected to the fourth switch to generate the second signal.

14. The plasma display device as claimed in claim 13, wherein the first switch and the third switch are turned on so that the first signal is supplied to the scan electrodes in a set up period of a reset period.

15. The plasma display device as claimed in claim 12, wherein the second switch and the fourth switch are turned on so that the second signal is supplied to the scan electrodes in a set down period of a reset period.

16. The plasma display device as claimed in claim 15, wherein a voltage of the second end of the capacitor is gradually reduced from the reference voltage to a negative polarity voltage in the set down period, and wherein an absolute value of the negative polarity voltage is actually equal to an absolute value of the sustain voltage.

17. The plasma display device as claimed in claim 12, wherein the scan driver further comprises a second voltage supplier for supplying the reference voltage to the second end of the capacitor.

18. The plasma display device as claimed in claim 17, wherein the second voltage supplier comprises:

a first diode having an anode end connected to the second end of the capacitor and having an cathode end connected to a reference voltage source;

a fifth switch turned on in order to supply the reference voltage to the second end of the capacitor; and a second diode having an cathode end connected to the fifth switch and having an anode end connected to the reference voltage source.

19. The plasma display device as claimed in claim 12, wherein the voltage of the first end of the capacitor is higher than the voltage of the second end of the capacitor.

* * * * *